US010798784B2

(12) United States Patent
De Luca et al.

(10) Patent No.: US 10,798,784 B2
(45) Date of Patent: Oct. 6, 2020

(54) ELECTRICAL ENERGY TRANSFER SYSTEM FOR A WIRE MESH HEATER

(71) Applicant: De Luca Oven Technologies, LLC, San Francisco, CA (US)

(72) Inventors: Nicholas P. De Luca, Carmel-by-the-Sea, CA (US); Andrew Perkins, Berkeley, CA (US)

(73) Assignee: De Luca Oven Technologies, LLC, San Francisco, CA (US)

( * ) Notice: Subject to any disclaimer, the term of this patent is extended or adjusted under 35 U.S.C. 154(b) by 494 days.

(21) Appl. No.: 15/543,260

(22) PCT Filed: Jan. 13, 2016

(86) PCT No.: PCT/US2016/013183

§ 371 (c)(1),
(2) Date: Aug. 9, 2017

(87) PCT Pub. No.: WO2016/115215

PCT Pub. Date: Jul. 21, 2016

(65) Prior Publication Data

US 2018/0027614 A1 Jan. 25, 2018

Related U.S. Application Data

(60) Provisional application No. 62/102,612, filed on Jan. 13, 2015, provisional application No. 62/218,578, filed on Sep. 15, 2015.

(51) Int. Cl.
*H05B 3/34* (2006.01)
*H05B 6/64* (2006.01)

(52) U.S. Cl.
CPC ..... *H05B 3/34* (2013.01); *H05B 6/6408* (2013.01); *H05B 2203/007* (2013.01);
(Continued)

(58) Field of Classification Search
CPC ..... H05B 3/34; H05B 3/0076; H05B 3/24; H05B 3/347; H05B 3/56; H05B 3/565;
(Continued)

(56) References Cited

U.S. PATENT DOCUMENTS 2,915,609 A * 12/1959 Johnston ..... H01H 85/055 337/159
4,581,522 A * 4/1986 Graham ..... F24D 19/1096 219/213

(Continued)

FOREIGN PATENT DOCUMENTS

DE 102009026216 A1 1/2011
GB 2484980 A 5/2012

(Continued)

OTHER PUBLICATIONS

Supplementary European Search Report from corresponding European Application No. 16737791 dated Aug. 1, 2018.

(Continued)

*Primary Examiner* — Shawntina T Fuqua
(74) *Attorney, Agent, or Firm* — Capitol City TechLaw, PLLC; Jasbir Singh

(57) ABSTRACT

The present teachings disclose a wire mesh heater including: a wire mesh element having a surface area including a non-contact area and a contact area along at least 50% of a wire mesh element length; a primary conductor including a slit having a contact surface, wherein the contact area contacts the contact surface to provide an electrical connection between the wire mesh element and the primary conductor. In some embodiments, the primary conductor is welded to the wire mesh element, wherein the contact area contacts the contact surface to provide an electrical connection between the wire mesh element and the primary conductor. In some embodiments, an elastic is stretched and secured tautly under tension prior to operation of the wire (Continued)

mesh heater, and the elastic keeps the wire mesh element tautly under tension during operation of the wire mesh heater.

22 Claims, 12 Drawing Sheets

(52) U.S. Cl.
CPC .. *H05B 2203/011* (2013.01); *H05B 2203/014* (2013.01); *H05B 2203/016* (2013.01)

(58) Field of Classification Search
CPC ..... H05B 6/6408; H05B 2203/007; H05B 2203/011; H05B 2203/014; H05B 2203/016; H05B 2203/032; H05B 2203/005; H05B 2203/015; H05B 2203/026; H05B 2203/035; F24C 7/043; F24C 7/065; F24C 7/088; F24C 7/081
See application file for complete search history.

(56) References Cited

U.S. PATENT DOCUMENTS

| | | | |
|---|---|---|---|
| 6,181,874 | B1 | 1/2001 | Ireland et al. |
| 6,353,211 | B1 | 3/2002 | Chen |
| 7,230,215 | B2 | 6/2007 | Lin |
| 8,126,319 | B2 | 2/2012 | De Luca |
| 8,145,548 | B2 | 3/2012 | De Luca |
| 8,498,526 | B2 | 7/2013 | De Luca |
| 8,731,385 | B2 | 5/2014 | De Luca |
| 8,954,351 | B2 | 2/2015 | De Luca |
| 2013/0105470 | A1 | 5/2013 | De Luca et al. |
| 2014/0197157 | A1 | 7/2014 | Aizawa et al. |

FOREIGN PATENT DOCUMENTS

| | | | |
|---|---|---|---|
| JP | S40026128 | | 1/1965 |
| JP | S50165899 | | 1/1977 |
| JP | S51019738 | | 8/1977 |
| JP | s52119544 | A | 10/1977 |
| JP | s62066590 | | 1/1987 |
| JP | s63119186 | A | 5/1988 |
| JP | h05014274 | | 1/1994 |
| JP | H11512224 | A | 10/1999 |
| JP | 2008114680 | | 5/2008 |
| WO | 2014208101 | A1 | 12/2014 |
| WO | 2015095191 | A1 | 6/2015 |

OTHER PUBLICATIONS

International Search Report for corresponding PCT application PCT/US2016/013183.

* cited by examiner

ELECTRICAL ENERGY TRANSFER SYSTEM FOR A WIRE MESH HEATER

CROSS REFERENCE TO RELATED APPLICATIONS

The present application is a 371 of International Patent Application No. PCT/US2016/013183 filed Jan. 13, 2016, which claims the benefit of U.S. Provisional Application No. 62/102,612, filed Jan. 13, 2015, and U.S. Provisional Application No. 62/218,578, filed Sep. 15, 2015, all of which are incorporated in their entirety by reference for all purposes as if fully set forth herein.

FIELD

The present disclosure teaches a wire mesh energy transfer system that enables an uninterrupted or long term consecutive heating of a wire mesh for use in high speed heating applications. In particular, the system includes a primary conductor having a primary bond to a wire mesh heater and a secondary conductor to allow for the efficient transfer of electrical energy to the electrode and from there to the wire mesh heater. Aspects of a wire mesh heating system and oven may be found in U.S. Pat. Nos. 8,126,319, 8,145,548 and 8,498,526, and U.S. application Ser. Nos. 13/284,426, 12/345,939, 13/405,975, 13/430,189, and 61/916,705 (provisional application) the contents of which are incorporated herein by reference in their entirety.

BACKGROUND

U.S. Pat. No. 8,498,526 to De Luca discloses using stored energy to energize a wire mesh heating element to heat an item within a heating cavity. Temperatures inside the heating cavity reach the temperature of the heating element itself very quickly, in some cases up to 1500° C. When the one or more elements are used without interruption, the heating cavity and wire mesh element holders holding the wire mesh heating element heat up. Without limitation, it is theorized that the wire mesh element holders heat due to heat from the wire mesh heating element and from transferring electrical energy at contact points. It is also theorized that the wire mesh heating element holders increase in temperature faster than the heating cavity.

A strong and stable electrical connection to the wire mesh is needed to provide even heating in the radiant oven and to extend the life of the wire mesh heating element. When an electrical connection to the element is not uniform, for example, when contact pressure between the wire mesh element holder and the wire mesh element is uneven then the electrical current tends to travel through or concentrates in the contact area where the contact is better. As such, the concentrated area of contact becomes hotter than the remaining area of the wire mesh element or the wire mesh element holder, and a failure point is created. The use of materials that are both strong at high temperatures, but are also electrically conductive is a difficult match to achieve at a reasonable price point. Many such materials, for example, aluminum, also melt well below the operating temperature of the wire mesh element.

Tensioning of a wire mesh heating element is also more difficult than the tensioning of a single wire strand as the expansion and contraction of the element can vary if the heating is uneven or the mesh is oriented in such a fashion that could create zones of greater expansion. This is especially true if the element is oriented as further described by De Luca in co-pending PCT application PCT/US14/70601 entitled "A Continuous Renewal System for a Wire Mesh Heating Element and a Woven Angled Wire Mesh", filed Dec. 16, 2014. The high rate cycling of the mesh further increases the probability of a mesh failure with an unevenly tensioned mesh. The use of a warped element in the heating or cooking chamber can cause uneven heating or cooking of the item.

In the prior art, changing wire mesh heating elements is difficult, however, it is needed for many commercial ovens. The use of fasteners that are tightened to a precise torque value is often difficult to achieve in the field, for example, for restaurants, where a lack of necessary training may be found.

SUMMARY

The present teachings provide embodiments of heating system and methods, and features thereof, which offer various benefits. The system can employ multiple electrodes, systems, operations, and the like to promote safe, efficient, and effective use of the devices and methods disclosed herein.

The present teachings disclose a wire mesh heater including: a wire mesh element having a surface area including a non-contact area and a contact area along at least 50% of a wire mesh element length; a primary conductor including a slit having a contact surface, wherein the contact area contacts the contact surface to provide an electrical connection between the wire mesh element and the primary conductor.

The present teachings disclose a wire mesh heater including: a wire mesh element having a surface area including a non-contact area and a contact area along at least 50% of a wire mesh element length; a primary conductor welded to the wire mesh element, wherein the contact area contacts the contact surface to provide an electrical connection between the wire mesh element and the primary conductor.

The present teachings disclose a wire mesh heater including: a wire mesh element having a surface area including a non-contact area and a contact area along at least 50% of a wire mesh element length; a conductor in electrical contact with the wire mesh; an elastic bonded to at least one edge of the wire mesh element; and a fastener to secure the elastic, wherein the contact area contacts the conductor and the elastic is stretched and secured tautly under tension to the fastener prior to operation of the wire mesh heater, and the elastic keeps the wire mesh element tautly under tension during operation of the wire mesh heater.

It is to be understood that both the foregoing general description and the following detailed description are exemplary and explanatory and are intended to provide further explanation of the invention as claimed.

BRIEF DESCRIPTION OF THE FIGURES

The accompanying drawings, which are included to provide a further understanding of the invention and are incorporated in and constitute a part of this specification, illustrate embodiments of the invention, and together with the description serve to explain the principles of the invention.

Figure 1A:
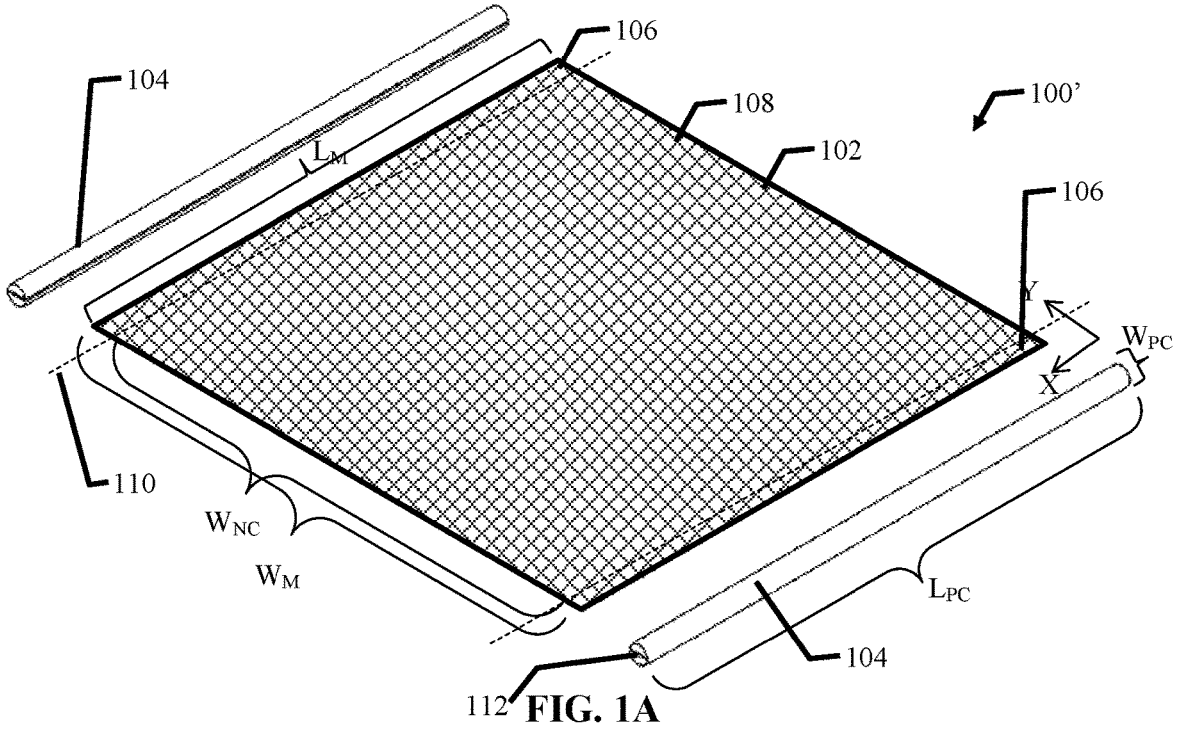
FIG. 1A is an isometric view of an unassembled wire mesh heater including a wire mesh element and a primary conductor according to various embodiments.

Throughout the drawings and the detailed description, unless otherwise described, the same drawing reference numerals will be understood to refer to the same elements, features, and structures. The relative size and depiction of these elements may be exaggerated for clarity, illustration, and convenience.

DESCRIPTION

The present teachings disclose efficiently transferring electrical energy to a wire mesh heating element. In exemplary embodiments, the transfer is evenly distributed over a breadth or length of the wire mesh. This may reduce the stress induced in the wire mesh, and reduce the heat being generated during the electrical energy transfer. The present teachings may evenly distribute any heat being generated during the electrical energy transfer. By reducing the heating and/or more evenly distributing the heat, the mean time between failures of the wire mesh heater may be increased.

The present teachings disclose a heating element system able to operate semi-continuously or continuously at high temperatures. The present teachings also disclose constant tensioning of a wire mesh heating element during use so that the element as a whole remains flat. The present teachings also disclose a wire mesh heating element that can operate in a heating cavity in a semi-continuous or continuous mode and that can be replaced easily.

In exemplary embodiments, a wire mesh heating assembly may include a primary conductor directly attached to the wire mesh heating element, and a secondary conductor or holder to secure the primary conductor through which the electrical current can flow. In some embodiments, the primary conductor may include a primary conduction rod or electrode.

According to various embodiments, the primary conductor may be continuous or fully or partially segmented. The primary conductor may contact a length of the wire mesh element.

The secondary conductor may tension, stretch or keep taut the wire mesh heating element in operation. In some embodiments, the secondary conductor may provide an adjustable tension for the wire mesh heating element in operation. The secondary conductor may include multiple tension points, a heat shield protection, and a latch or the like to provide ease of gripping and release of the primary conductor.

In exemplary embodiments, a flexible or movable electrical connection may connect an electrical energy source to the primary conductor. The flexible or movable electrical connection may include a stranded wire or telescoping nested tubes attached to the secondary conductor.

FIG. 1A is an isometric view of an unassembled wire mesh heater including a wire mesh element and a primary conductor according to various embodiments. An unassembled wire mesh heater 100' may include a wire mesh element 102 and a primary conductor 104. The wire mesh element 102 may have a length $L_M$, for example, along an X-axis. The wire mesh element 102 may have a width $W_M$, for example, along a Y-axis. The wire mesh element 102 may be planar. The wire mesh element 102 may be planar after application of a force or tension along the X-axis and the Y-axis. A surface of the wire mesh element 102 may be divided into a contact area 106 and a non-contact area 108. The non-contact area 108 may include a majority of the surface of the wire mesh element 102. The contact area 106 may be separated from the non-contact area 108 by an imaginary axis 110. The non-contact area 108 may have a width $W_{NC}$ that is smaller than the width $W_M$ of the wire mesh element 102. The non-contact area 108 may be adjacent to the contact area 106. In some embodiments, the non-contact area 108 may be surrounded by two contact areas 106. The primary conductor 104 may have a length $L_{PC}$ and a width $W_{PC}$. The primary conductor 112 may include a slit 112. The slit 112 may run along the whole $W_{PC}$ or a portion thereof. The slit 112 may run along the whole $L_{PC}$ or a portion thereof. In some embodiments, the length $L_{PC}$ may be greater than or equal to the length $L_M$.

Figure 1B:
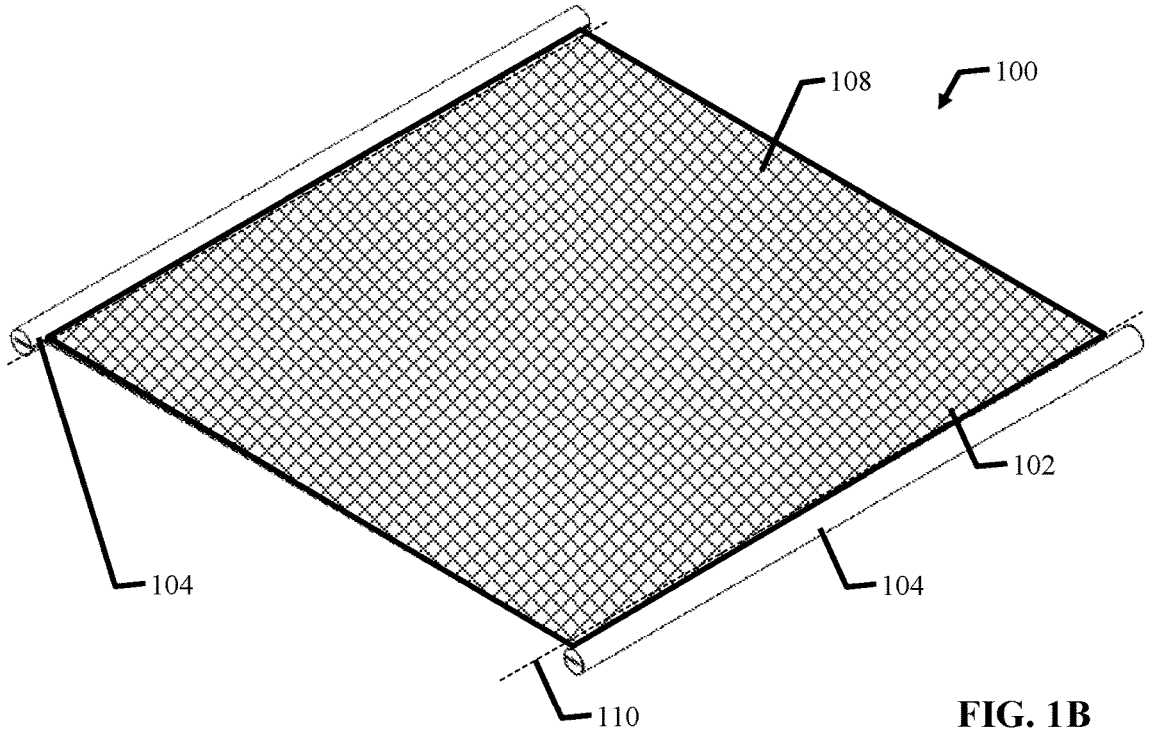
FIG. 1B is an isometric view of an assembled wire mesh heater including a wire mesh element and a primary conductor according to various embodiments.

FIG. 1B is an isometric view of an assembled wire mesh heater including a wire mesh element and a primary conductor according to various embodiments. An assembled wire mesh heater 100 may include the wire mesh element 102 and the primary conductor 104. In the assembled wire mesh heater 100 the contact area 106 of FIG. 1 maybe secured in the slit 112 along the imaginary axis 110. The securing of the wire mesh heater 100 in the slit 112 may be bonded with a press. In some embodiments, the assembled wire mesh heater 100 is formed by assembling the unassembled wire mesh heater 100' of FIG. 1A.

Figure 2A:
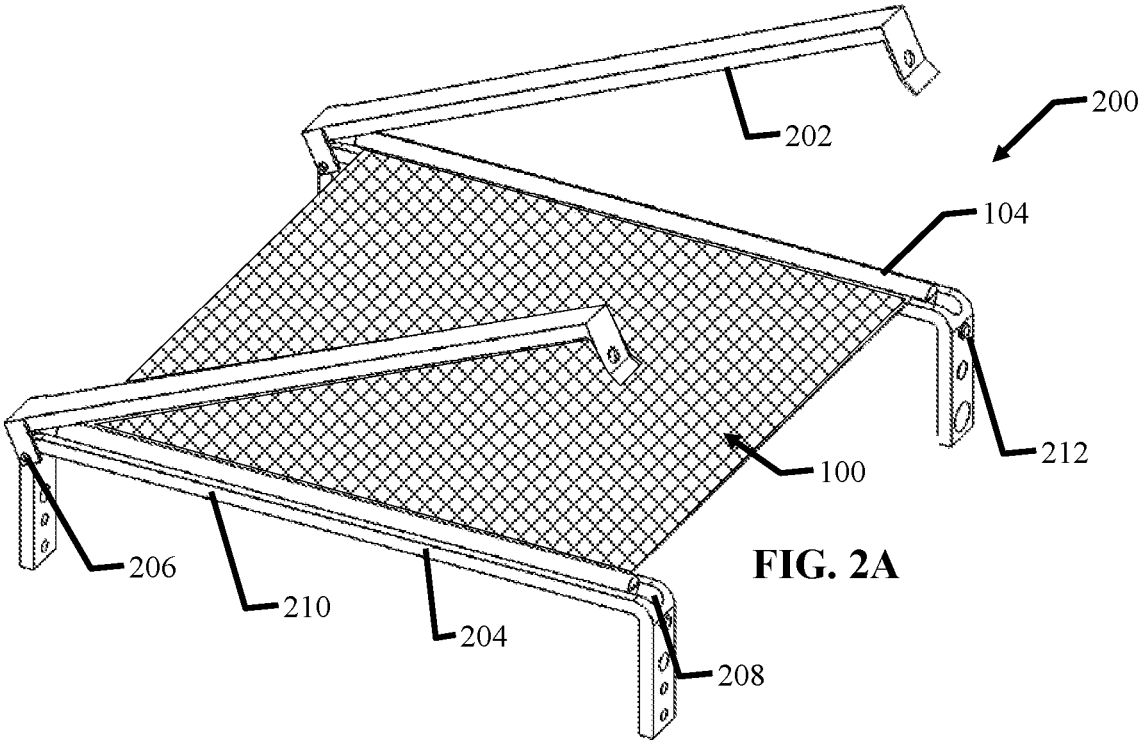
FIG. 2A is an isometric view of a wire mesh heater assembly including a wire mesh element and a primary conductor according to various embodiments.

FIG. 2A is an isometric view of a wire mesh heater assembly including a wire mesh element and a primary conductor according to various embodiments. A wire mesh heater assembly 200 may include an assembled wire mesh heater 100 including a wire mesh element 102 and a primary conductor 104. The wire mesh heater assembly 200 may include a first portion 202 of a secondary conductor 210 that engages with a second portion 204 of the secondary conductor 210. The first portion 202 of the secondary conductor 210 may connect to the second portion 204 of the secondary conductor 210 at a hinge 206 or the like about which the first portion 202 can pivot to join with the second portion 204.

The second portion 204 of the secondary conductor 210 may include a trough or void 208 to trap a portion of the primary conductor 102. The first portion 202 of the secondary conductor 210 may include a trough or void (not shown), similar to trough or void 208, to trap a portion of the primary conductor 102. The second portion 204 of the secondary conductor 210 may include a fastener 212 to secure the first portion 202 and the second portion 204.

Figure 2B:
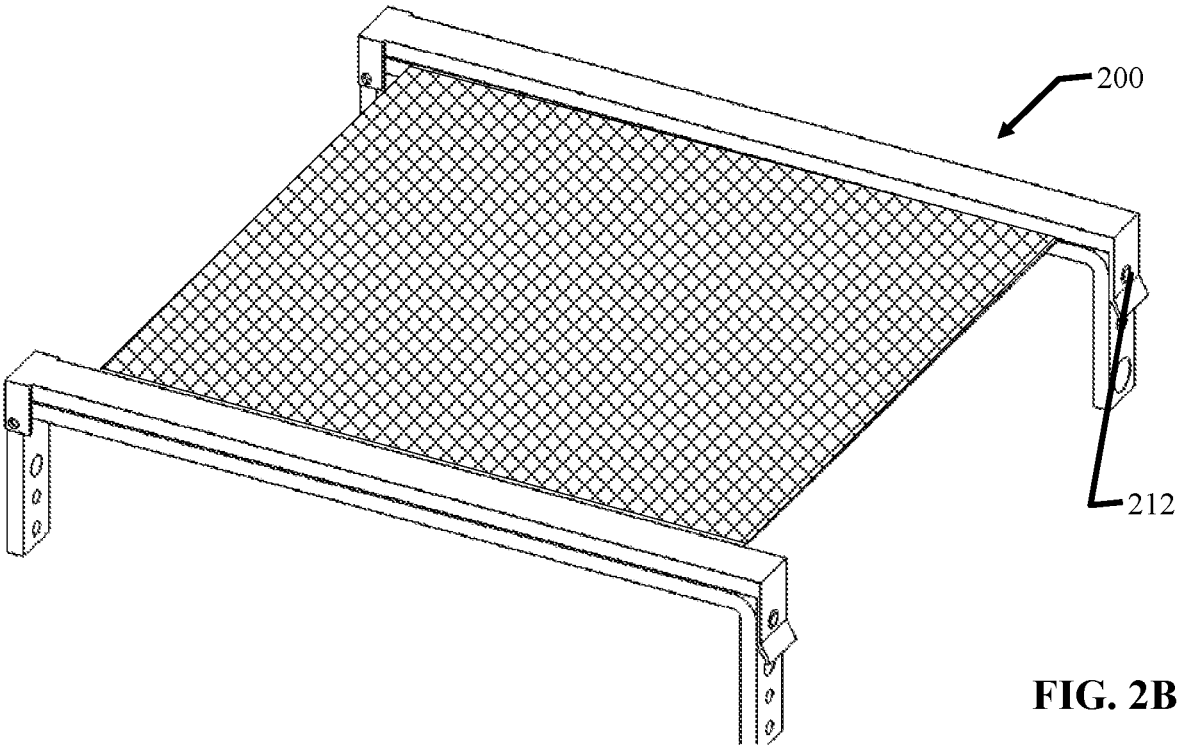
FIG. 2B is an isometric view of a wire mesh heater assembly including a wire mesh element and a primary conductor according to various embodiments.

FIG. 2B is an isometric view of a wire mesh heater assembly including a wire mesh element and a primary conductor according to various embodiments. The wire mesh heater assembly 200 may be secured by disposing closing the first portion 202 and securing it with the fastener 212. According to various embodiments, in FIG. 2B the hinge 206 is in a closed position such that the first portion 202 joins or meets the second portion 204 along a majority of a length of the first portion 204.

Figure 3A:
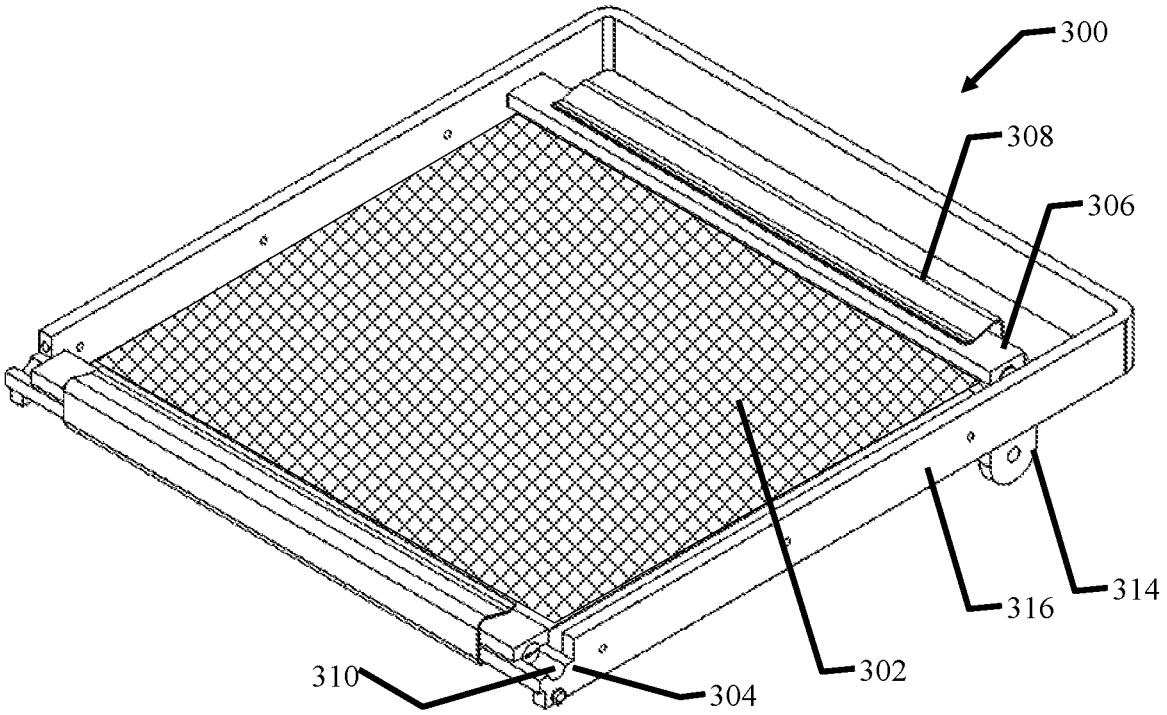
FIG. 3A is an isometric view of a wire mesh heater assembly including a wire mesh element and a primary conductor according to various embodiments.
Figure 3B:
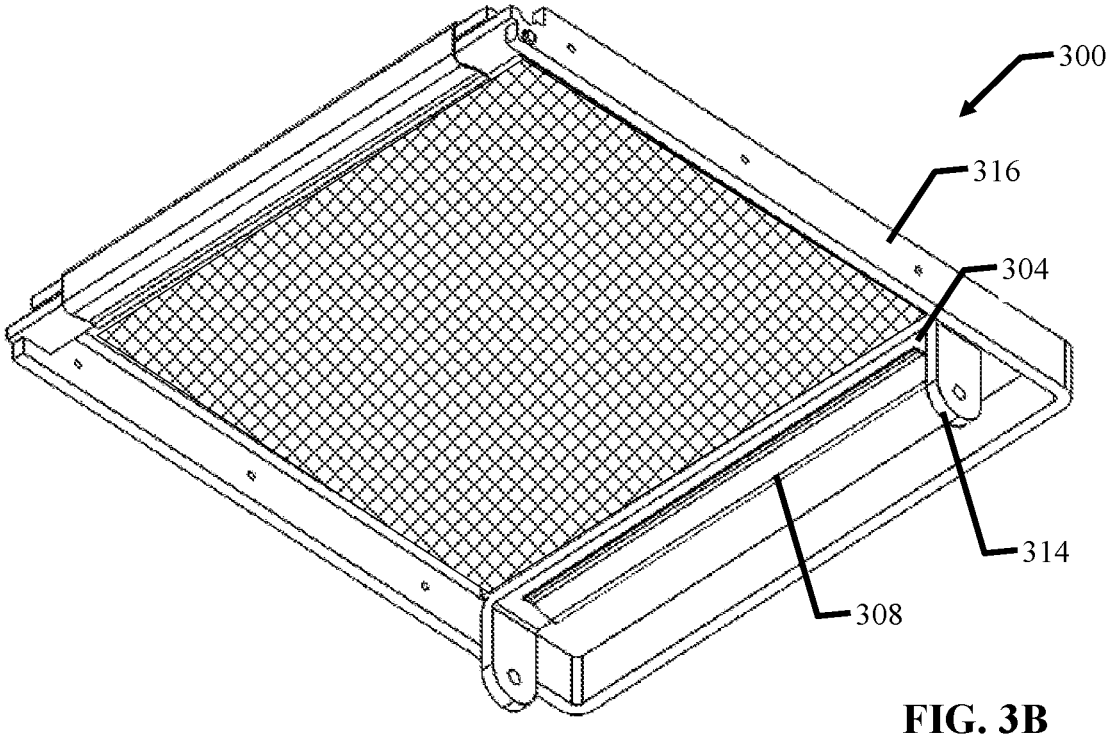
FIG. 3B is an isometric view of a wire mesh heater assembly including a wire mesh element and a primary conductor according to various embodiments.
Figure 3C:
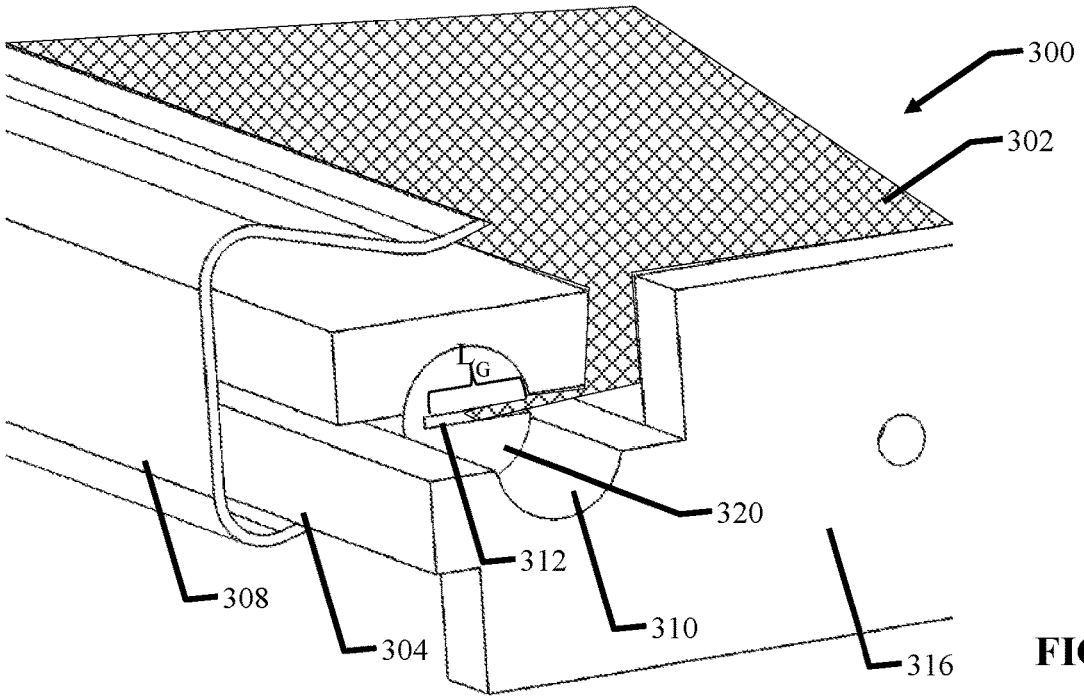
FIG. 3C is an enlarged isometric view of a wire mesh heater assembly of FIG. 3A including a connection point between the primary conductor and a secondary conductor according to various embodiments.

FIG. 3A is an isometric view of a wire mesh heater assembly including a wire mesh element and a primary conductor according to various embodiments. FIG. 3B is an isometric view of a wire mesh heater assembly including a wire mesh element and a primary conductor according to various embodiments. FIG. 3C is an enlarged isometric view of a wire mesh heater assembly of FIG. 3A including a connection point between the primary connection rod and a secondary connector according to various embodiments.

A wire heater assembly 300 may include a wire mesh element 302, a primary conductor 320 to secure the wire mesh element 302 in a slit 312 (see FIG. 3C), a first portion 306 of a secondary conductor, a fastener 308, and a groove 310 in a second portion 304 of the secondary conductor to secure the primary conductor 320 when the fastener 308 is disposed to secure the first portion 306 to the second portion 304. A length $L_G$ of the slit 312 (see FIG. 3C) can be less than a diameter or cross-width of the primary conductor 320. The wire mesh hearing element 302 may be secured in the slit 312. The slit 312 may be crimped to secure the write mesh hearing element 302. The crimping may be performed by pressing the slit 312 closed, for example, with a press. In some embodiments, the second portion 306 of the secondary conductor can be disposed in a frame 316. As such, the frame 316 may form one pole of an electrical circuit energizing the wire mesh hearing element 302.

In some embodiments, an electrical cable connector 314 can extend from the secondary conductor. The frame 316 can pivot about the electrical cable connector 314. In some embodiments, the electrical cable connector can be disposed on the second portion 304 of the secondary conductor (see FIG. 3B). The second portion 304 of the secondary conductor may be electrically insulated from the frame 316 by insulating washers (not shown).

Figure 4A:
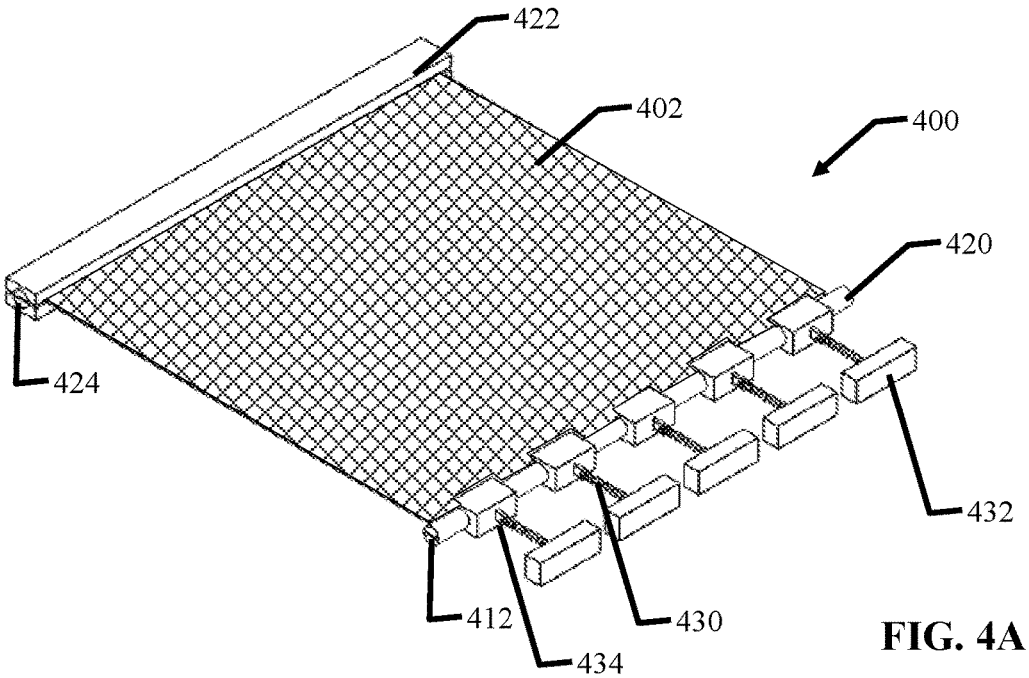
FIG. 4A is an isometric view of a tensioning system based on multiple tensioned points and a partially segmented primary conductor according to various embodiments.

FIG. 4A is an isometric view of a tensioning wire mesh heater assembly based on multiple tensioned points and a partially segmented primary conductor according to various embodiments.

A tensioning wire mesh heater assembly 400 may include a wire mesh heater 402 and a first conductor assembly 420 including multiple tensioning points 432 connected via springs 430 to a segmented secondary conductor 434. The first conductor assembly 420 may include a primary conductor 412 with a slit therein. In some embodiments, the tensioning wire mesh heater assembly 400 may include a second conductor assembly 422 including a primary conductor 424 including a slit. The second conductor assembly 422 may be fixedly held at a first end of an oven cavity. The multiple tensioning points 432 may be fixedly held at a second end opposite the first end of the oven cavity. As the wire mesh heater 402 stretches due, for example, to the stress of repeated heating of the oven, the springs 430 may keep the wire mesh heater 402 taut. According to various embodiments, the segmented secondary conductor 434 of the first conductor assembly 420 may be connected to one pole of an electrical power source, and the second conductor assembly 422 may be connected to another pole of the electrical power source.

Figure 4B:
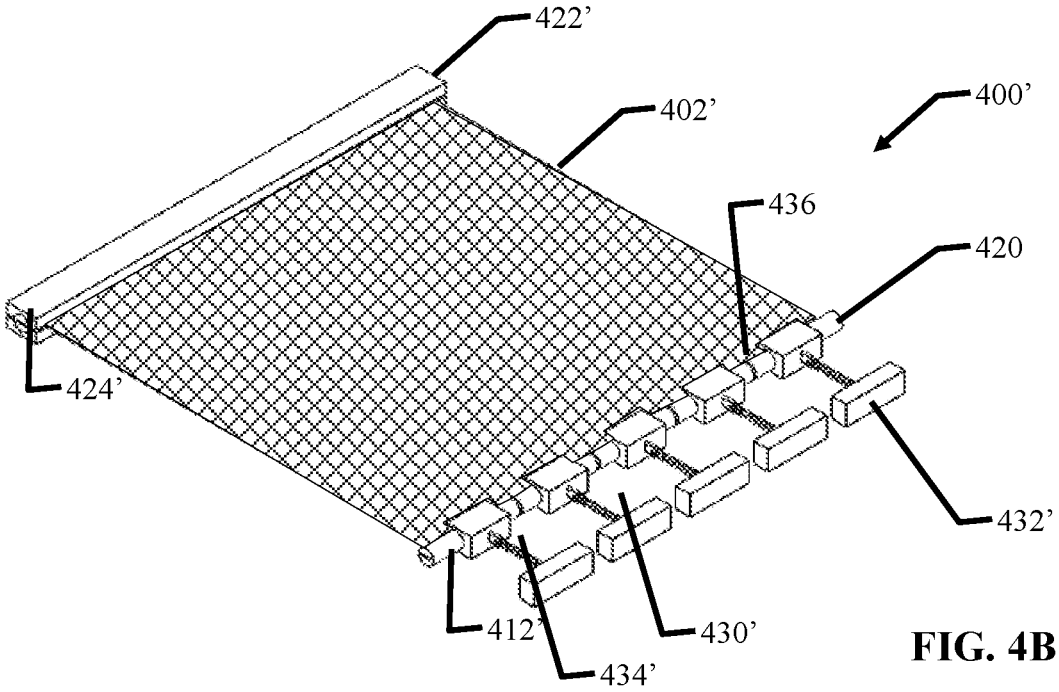
FIG. 4B is an isometric view of a tensioning system based on multiple tensioned points and a fully segmented primary conductor according to various embodiments.

FIG. 4B is an isometric view of a tensioning system based on multiple tensioned points and a fully segmented primary conductor according to various embodiments.

A tensioning wire mesh heater assembly 400' may include a wire mesh heater 402' and a first conductor assembly 420' including multiple tensioning points 432' connected via springs 430' to a segmented secondary conductor 434'. The first conductor assembly 420 may include a segmented primary conductor 412' with a slit therein. The segmented primary conductor 412' may be segmented by a cut 436 across the full or partial width of the segmented primary conductor 412'. In some embodiments, the tensioning wire mesh heater assembly 400 may include a second conductor assembly 422' including a primary conductor 424' including a slit. The second conductor assembly 422' may be fixedly held at a first end of an oven cavity. The multiple tensioning points 432' may be fixedly held at a second end opposite the first end of the oven cavity. As the wire mesh heater 402' stretches due, for example, to the stress of repeated heating of the oven, the springs 430' may keep the wire mesh heater 402' taut. According to various embodiments, the segmented secondary conductor 434' of the first conductor assembly 420' may be connected to one pole of an electrical power source, and the second conductor assembly 422' may be connected to another pole of the electrical power source.

Figure 5A:
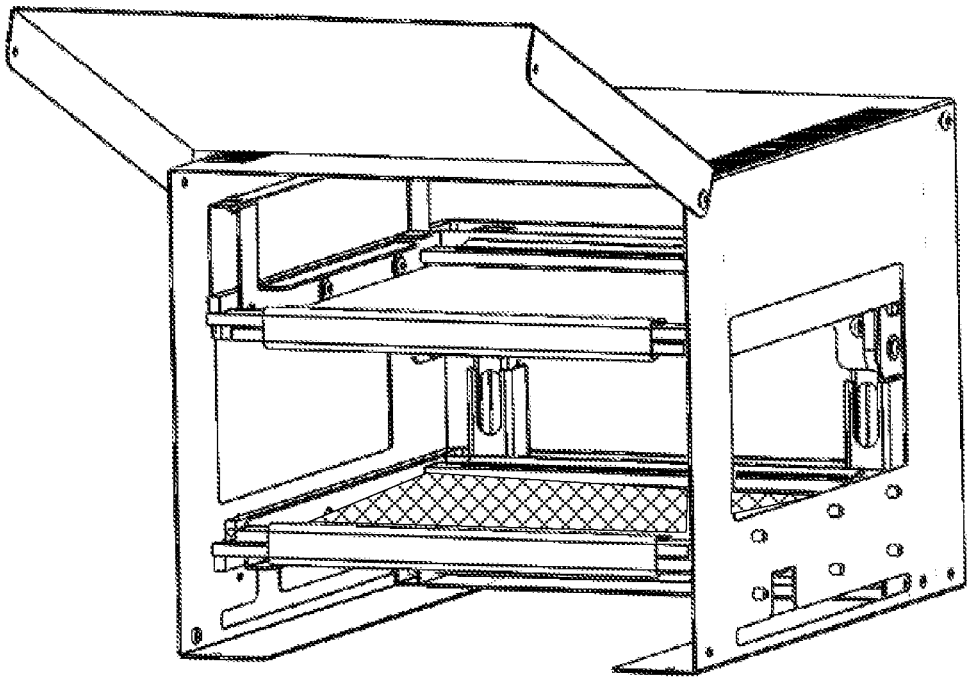
FIG. 5A and FIG. 5B are isometric views of an oven cavity including a wire mesh heater assembly disposed therein according to various embodiments.
Figure 5B:
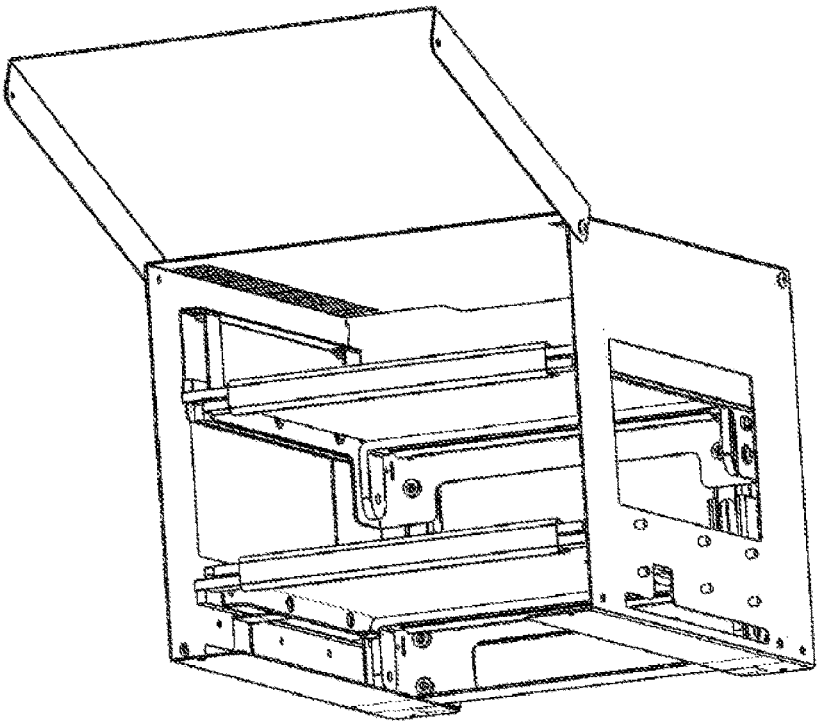

FIG. 5A and FIG. 5B are isometric views of an oven cavity including a wire mesh heater assembly disposed therein according to various embodiments.

Figure 5C:
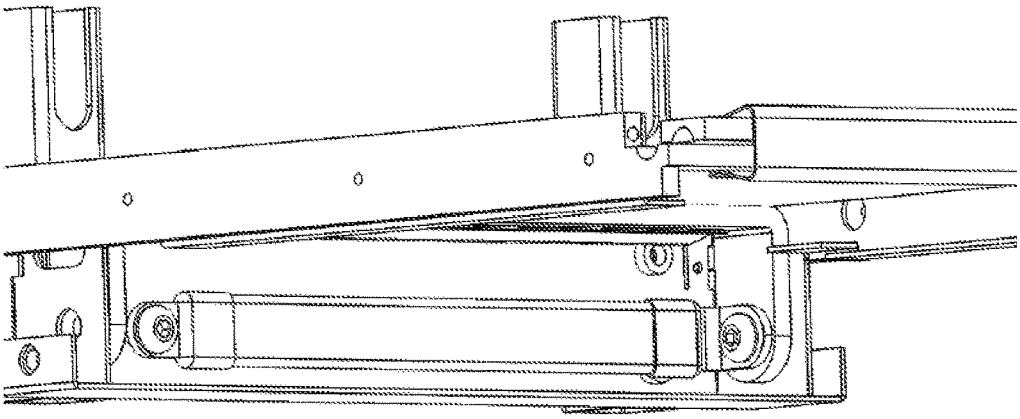
FIG. 5C is an enlarged isometric view of an oven cavity including a wire mesh heater assembly and a flexible braided connection to a secondary conductor according to various embodiments.

FIG. 5C is an enlarged isometric view of an oven cavity including a wire mesh heater assembly and a flexible braided connection to a secondary conductor according to various embodiments.

Figure 6A:
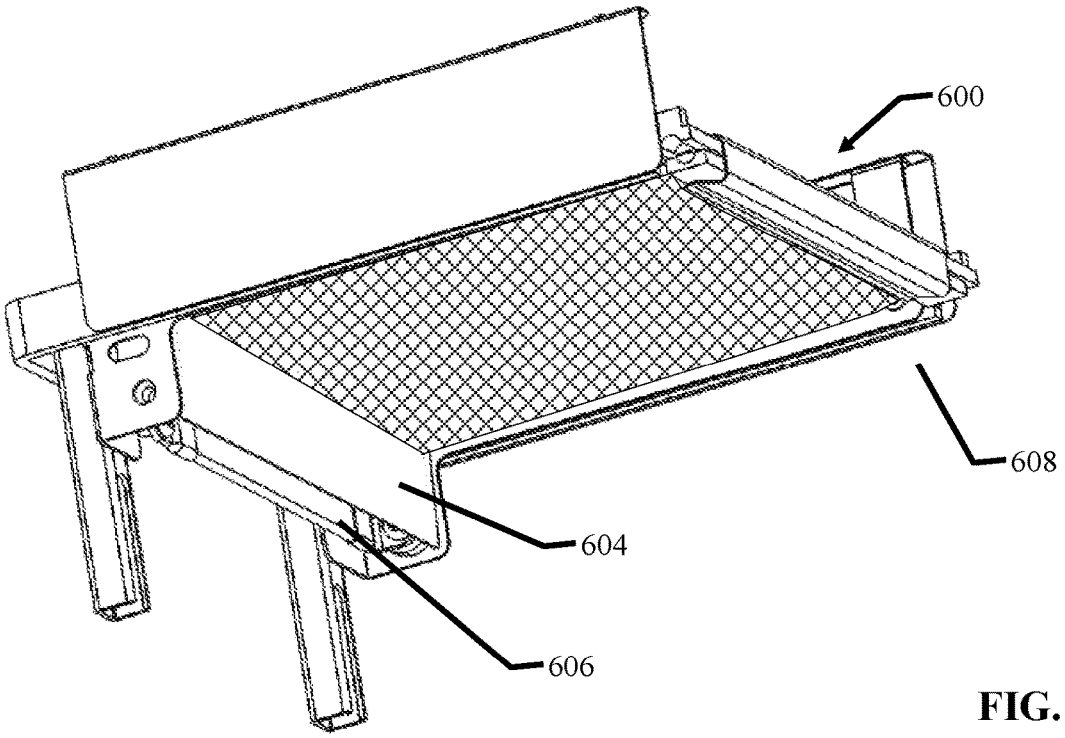
FIG. 6A and FIG. 6B are isometric views of a cooking cavity with heat shielding to thermally protect the primary conductor and an elevator usable to alter the distance between two wire mesh heater assemblies according to various embodiments.
Figure 6B:
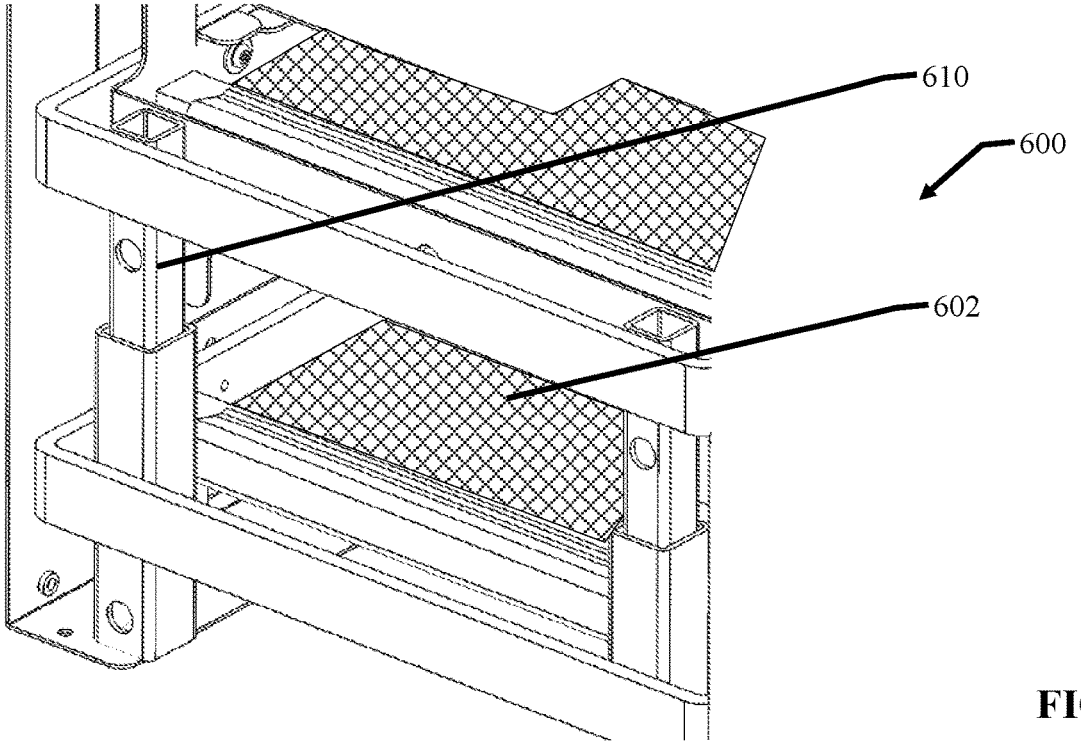

FIG. 6A and FIG. 6B are isometric views of a cooking cavity with heat shielding to thermally protect the primary conductor and an elevator usable to alter the distance between two wire mesh heater assemblies according to various embodiments.

An oven 600 may include a cooking cavity 602. A wall 604 may be disposed as a heat shield. The wall 604 may thermally isolate or protect a primary conductor 606 from heat generated by a wire mesh heater assembly 608. An elevator 610 may alter a gap or distance between two wire mesh heater assemblies 608, according to various embodiments.

Figure 7:
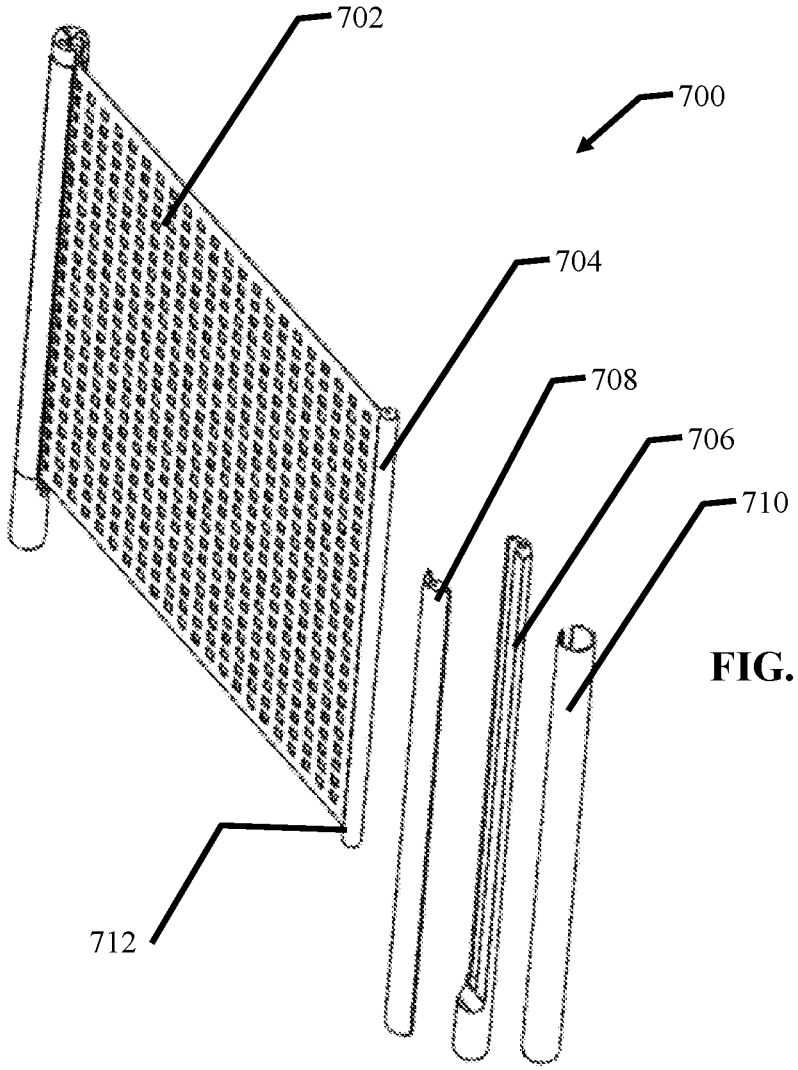
FIG. 7 is an isometric view of a wire mesh heater assembly, according to various embodiments.

FIG. 7 is an isometric view of a wire mesh heater assembly, according to various embodiments.

The wire mesh heater assembly 700 may include a wire mesh 702 secured to a primary conductor 704 by a solder, swage or weld 712. The primary conductor 704 of the wire mesh heater assembly 700 may be secured by a secondary conductor 706 and 708. Secondary conductor 7678 may be covered or coded with an insulative material 710.

Figure 8:
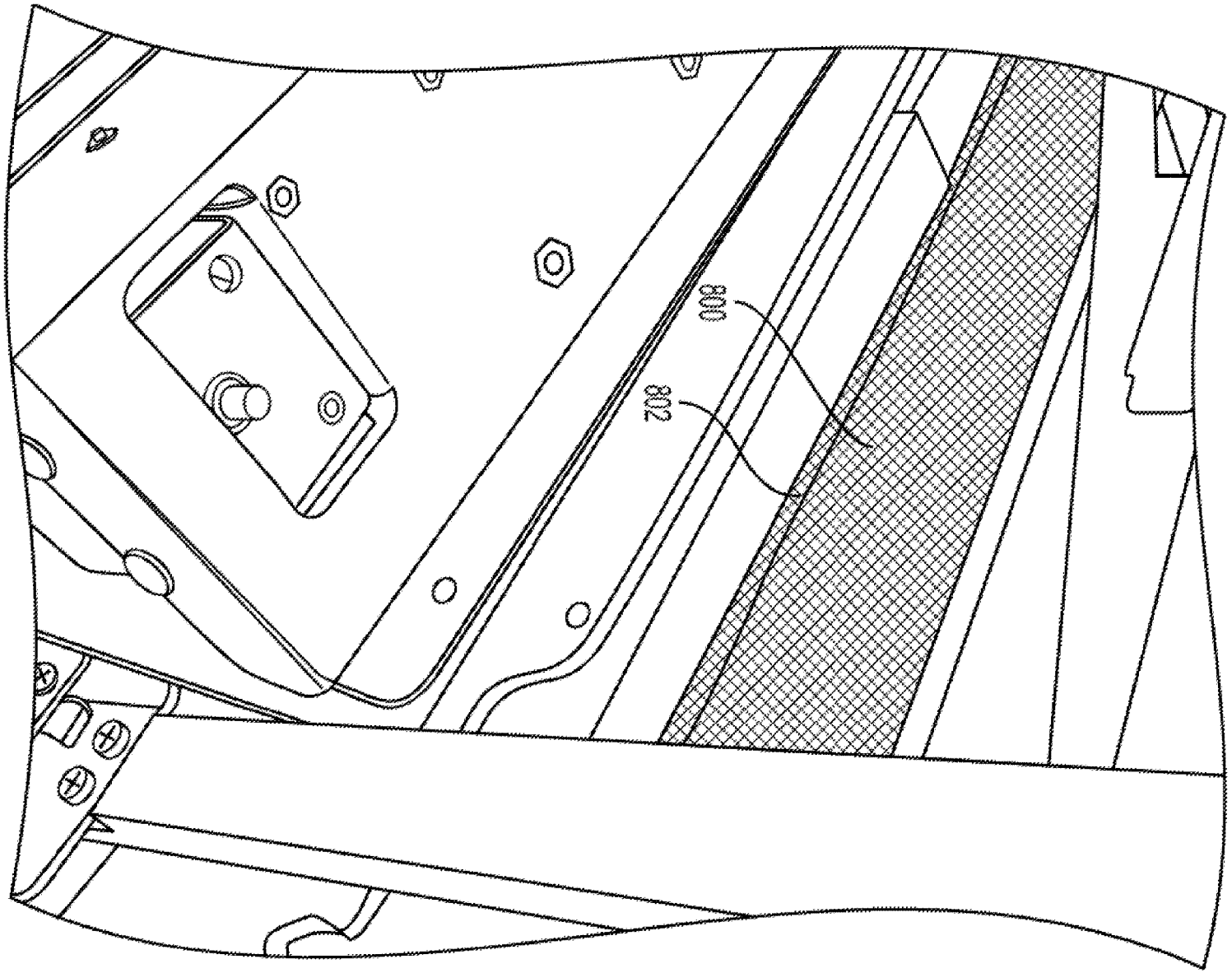
FIG. 8 is an isometric view of a wire mesh heater assembly, according to various embodiments.

FIG. 8 is an isometric view of a wire mesh heater assembly, according to various embodiments.

A wire mesh 800 can be provided with a bent edge 802 along a periphery of the wire mesh. In some embodiments, the wire mesh 800 may be provided with a second bent edge (not shown) along an edge opposite the bent edge 802. The bent edge 802 may reduce a flex produced in the wire mesh 800 when the wire mesh 800 is heated to high temperatures.

Figure 9B:
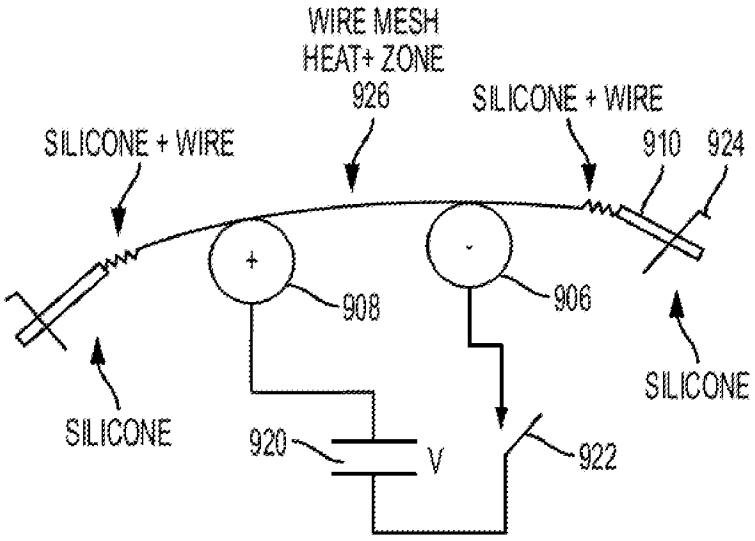
FIG. 9B is a logical view of a wire mesh heater assembly, according to various embodiments.
Figure 9A:
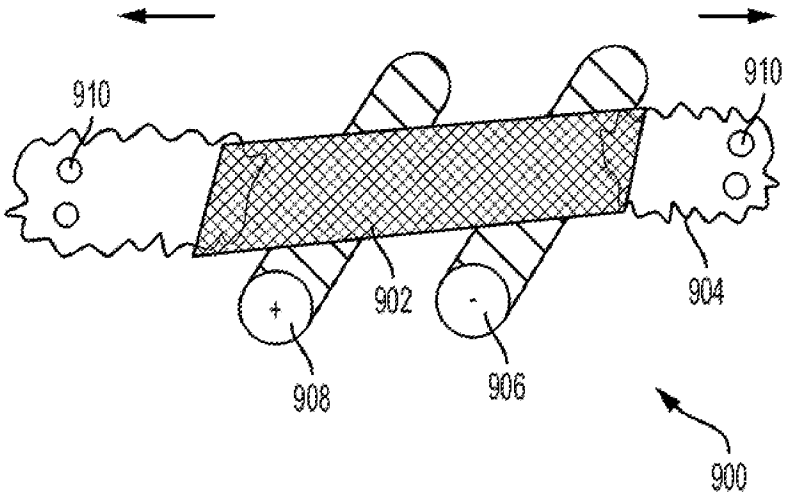
FIG. 9A is an isometric view of a wire mesh heater assembly, according to various embodiments.

FIG. 9A is an isometric view of a wire mesh heater assembly, according to various embodiments.

FIG. 9B is a logical view of a wire mesh heater assembly, according to various embodiments.

The wire mesh assembly 900 may include the wire mesh 902 and a thermal insulative material 904 disposed along an edge of the wire mesh 902. The insulative material 904 may include a fastener 910 that can be secured in a wire mesh heater. The wire mesh assembly 900 can be disposed over two conductors 906, 908 to provide a heat zone 926 between the two conductors 906, 908. The two conductors 906, 908 can be energized by a voltage source 920 in series with a switch 922. The fastener 910 can be secured to a chassis of the wire mesh heater (not shown) using a fastener holding device 924. In some embodiments, the thermal insulating material 904 can include silicon. The wire mesh assembly 900 can be fastened under tension (tautly).

Figure 10:
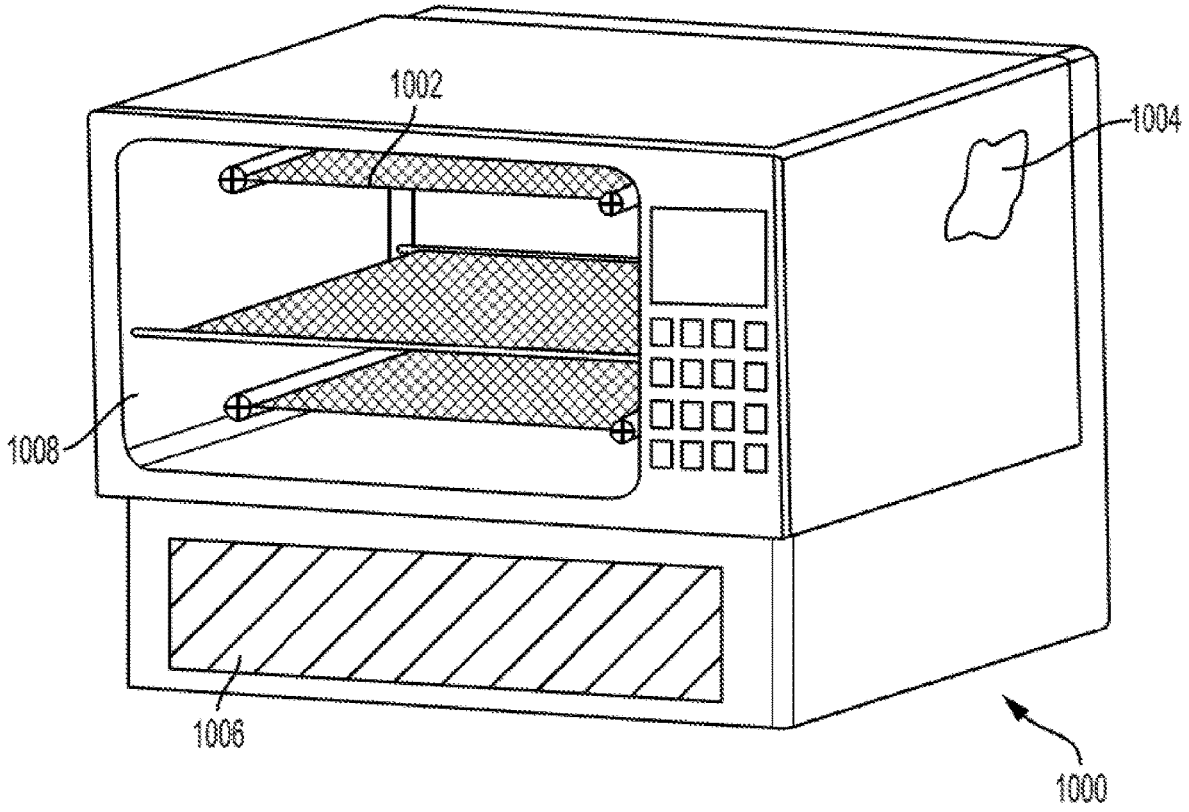
FIG. 10 is an isometric of a wire mesh and microwave heater, according to various embodiments.

FIG. 10 is an isometric of a wire mesh and microwave heater, according to various embodiments.

A wire mesh and microwave heater 1000 may include the wire mesh element 1002, a magnetron 1004 and a high wattage power supply 1006 including a stored energy device. The wire mesh element 1002 can be disposed in a heating cavity 1008 where radiation from the magnetron 1004 impinges on the wire mesh element 1002. Both the magnetron 1004 and the wire mesh element 1002 may be operated simultaneously. Power in excess of the capacity of the AC power line may be provided by the stored energy device includes with the high wattage power supply 1006.

Figure 11A:
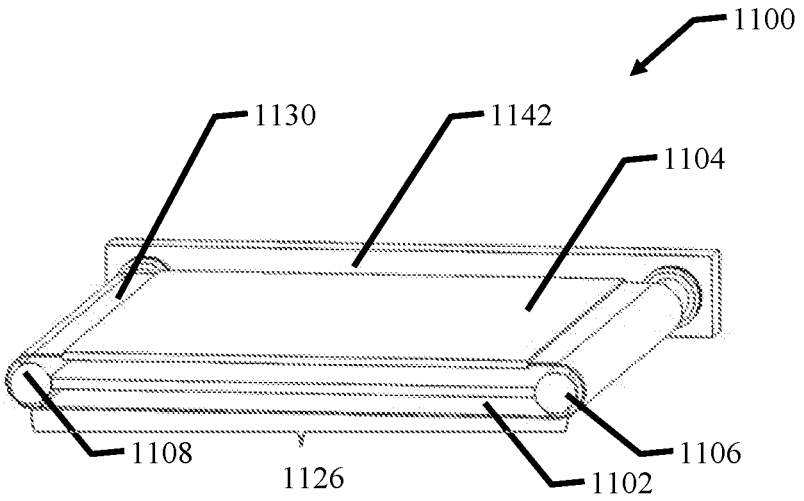
FIG. 11A is an isometric view of a wire mesh heater assembly, according to various embodiments.

FIG. 11A is an isometric view of a wire mesh heater assembly, according to various embodiments.

Figure 11B:
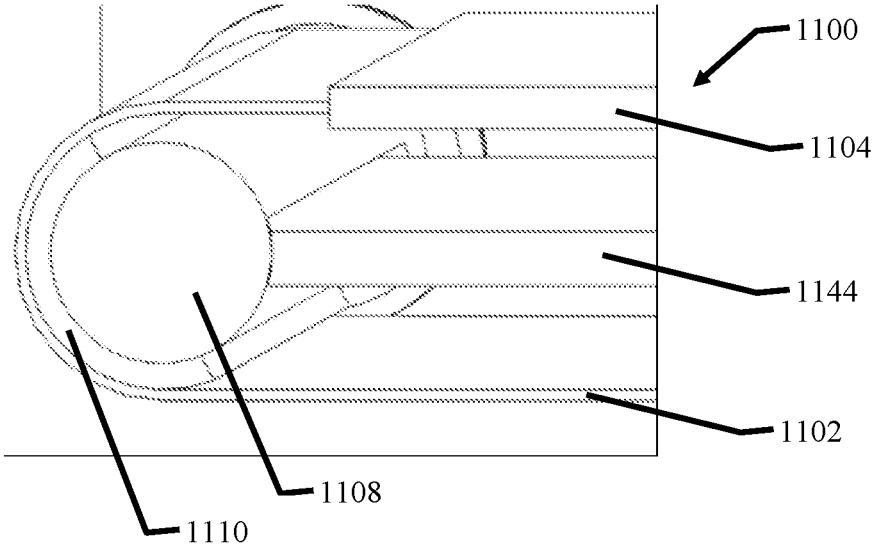
FIG. 11B is a logical view of a wire mesh heater assembly, according to various embodiments.

FIG. 11B is a logical view of a wire mesh heater assembly, according to various embodiments.

A wire mesh assembly 1100 may include the wire mesh 1102 and an elastic 1104. The wire mesh assembly 1100 may include a secondary conductor 1110. The elastic 1104 may be secured, fastened or joined to one or more edges of the wire mesh 1102 to form a bendable closed loop 1130. The elastic 1104 maybe fastened to one or more edges of the wire mesh 1102 using a fastener (not shown) such as a bolt and nut, or the like. The elastic 1104 maybe secured or joined to one or more edges of the wire mesh 1102 by embedding one of the edges in the elastic 1104. The closed loop 1130 may be disposed over two conductors 1106, 1108 to provide a heat zone 1126 between the two conductors 1106, 1108 (primary conductors). In exemplary embodiments, the secondary 1110 contacts one or more of the two conductors 1106, 1108. The two conductors 1106, 1108 can be energized by a voltage source (not shown) in series with a switch (not shown).

The elastic 1104 may be a springy material able to withstand high temperatures, for example, silicone. The wire mesh 1102 may be secured or fastened to the secondary conductor 1110. The secondary conductor 1110 may be movably disposed over one or more of the two conductors 1106, 1108 in order to provide a high-performing electrical contact between the wire mesh 1102 and one or more of the two conductors 1106, 1108. In some embodiments, a solder, swage, weld or the like may be used to secure the wire mesh 1102 to the secondary conductor 1110. The wire mesh assembly 1100 can be disposed under tension (tautly) over the two conductors 1106, 1108. In some embodiments, the two conductors 1106, 1108 may be immovably secured in a holder 1142. In some embodiments, one of the two conductors 1106, 1108 may be movably secured in the holder 1142, while the other of the two conductors 1106, 1108 may be immovably secured in the holder 1142. A heat shield 1144 may be disposed between the heat zone 1126 and the elastic material 1104.

The examples presented herein are intended to illustrate potential and specific implementations. It can be appreciated that the examples are intended primarily for purposes of illustration for those skilled in the art. The diagrams depicted herein are provided by way of example. There can be variations to these diagrams or the operations described herein without departing from the spirit of the invention. For instance, in certain cases, method steps or operations can be performed in differing order, or operations can be added, deleted or modified.

We claim:

1. A wire mesh heater comprising:

a wire mesh element having a surface area comprising a non-contact area and a contact area along at least 50% of a wire mesh element length;

a primary conductor comprising a slit having a contact surface;

a heating cavity comprising a first surface defined by the non-contact surface of the wire mesh element; and a heat shield disposed in the heating cavity, wherein the heat shield is disposed adjacent to the primary conductor to reflect a majority of the heat radiation generated by the non-contact surface away from the primary conductor, wherein the contact area contacts the contact surface to provide an electrical connection between the wire mesh element and the primary conductor.

2. The wire mesh heater of claim 1, wherein the slit is compressed after disposing the contact area of the wire mesh element in the slit.

3. The wire mesh heater of claim 1, wherein the slit is compressed with a hydraulic press after disposing the contact area of the wire mesh element in the slit.

4. The wire mesh heater of claim 1, further comprising:

a Direct Current (DC) power supply; and a braided electrical cable to electrically connect the DC power supply with the primary conductor.

5. The wire mesh heater of claim 1, wherein the primary conductor is partially segmented.

6. A wire mesh heater comprising:

a wire mesh element having a surface area comprising a non-contact area and a contact area along at least 50% of a wire mesh element length;

a primary conductor comprising a slit having a contact surface;

a secondary conductor configured to secure the primary conductor and configured to provide an electrical connection to the primary conductor; and a chassis to secure the secondary conductor, wherein the contact area contacts the contact surface to provide an electrical connection between the wire mesh element and the primary conductor.

7. The wire mesh heater of claim 6, further comprising:

a Direct Current (DC) power supply; and a braided electrical cable to electrically connect the DC power supply with the secondary conductor to electrically connect the DC power supply with the primary conductor.

8. The wire mesh heater of claim 6, further comprising:

a heating cavity comprising a first surface defined by the non-contact surface of the wire mesh element; and a heat shield disposed in the heating cavity, wherein the heat shield is disposed adjacent to the primary conductor to reflect a majority of the heat radiation generated by the non-contact surface away from the primary conductor.

9. The wire mesh heater of claim 6, further comprising tension springs disposed between the primary conductor and the secondary conductor.

10. The wire mesh heater of claim 9, wherein the primary conductor is partially segmented.

11. The wire mesh heater of claim 6, wherein the primary conductor comprises a first conductor and a second conductor, the secondary conductor comprising a first secondary conductor and a second secondary conductor, the first conductor is secured to the first secondary conductor, the second conductor is secured to the second secondary conductor, and the wire mesh element is disposed between the first conductor and the second conductor.

12. The wire mesh heater of claim 11, further comprising tension springs disposed between the first conductor and the first secondary conductor, wherein the primary conductor is partially segmented.

13. The wire mesh heater of claim 11, further comprising:

a heating cavity comprising a first surface defined by the non-contact surface of the wire mesh element;

a first heat shield disposed in the heating cavity disposed adjacent to the primary conductor to reflect a majority of the heat radiation generated by the non-contact surface away from the first conductor; and a second heat shield disposed in the heating cavity disposed adjacent to the primary conductor to reflect a majority of the heat radiation generated by the non-contact surface away from the second conductor.

14. The wire mesh heater of claim 1, wherein the primary conductor comprises a metal rod coated with a heat-resistant alloy.

15. The wire mesh heater of claim 1, wherein the wire mesh element is welded to at least a portion of the contact area of the primary conductor.

16. The wire mesh heater of claim 1, wherein the non-contact area of the wire mesh element comprises an edge area that is angled with respect to a non-edge area of the non-contact area of the wire mesh element.

17. The wire mesh heater of claim 1, wherein the primary conductor comprises a non-contact surface covered by an electrical insulator.

18. The wire mesh heater of claim 17, wherein the electrical insulator has a thickness of at least 0.03 inches and the electrical insulator comprises an insulative paint or a ceramic coating.

19. The wire mesh heater of claim 1, wherein the primary conductor comprises a metal rod coated with a heat-resistant alloy, and wherein the primary conductor comprises a non-contact surface covered by an electrical insulator.

20. A wire mesh heater comprising:

a wire mesh element having a surface area comprising a non-contact area and a contact area along at least 50% of a wire mesh element length;

a primary conductor welded to the wire mesh element, wherein the contact area contacts the contact surface to provide an electrical connection between the wire mesh element and the primary conductor.

21. A wire mesh heater comprising:

a wire mesh element having a surface area comprising a non-contact area and a contact area along at least 50% of a wire mesh element length;

a conductor in electrical contact with the wire mesh;

an elastic bonded to at least one edge of the wire mesh element; and a fastener to secure the elastic thermal insulator to the wire mesh, wherein the contact area contacts the conductor and the elastic is stretched and secured tautly under tension prior to operation of the wire mesh heater, and the elastic keeps the wire mesh element tautly under tension during operation of the wire mesh heater.

22. The wire mesh heater of claim 21, wherein the elastic thermal insulator comprises silicon.

* * * * *